US006013614A

United States Patent [19]

Mahdessian

[11] Patent Number: 6,013,614

[45] Date of Patent: Jan. 11, 2000

[54] COMPREHENSIVE STAIN REMOVAL KIT

[76] Inventor: John Mahdessian, 42 W. 83rd. St. (4A), New York, N.Y. 10024

[21] Appl. No.: 08/912,657

[22] Filed: Aug. 18, 1997

[51] Int. Cl.[7] ..... C11D 17/04

[52] U.S. Cl. ..... 510/277; 510/281; 510/297; 510/363; 510/406; 510/438; 510/439; 206/484; 206/484.2; 206/524.2; 206/812

[58] Field of Search ..... 510/438, 277, 510/439, 406, 281, 297, 363; 206/812, 823, 484, 484.2, 524.2

[56] References Cited

U.S. PATENT DOCUMENTS

| | | | |
|---|---|---|---|
| 2,980,941 | 4/1961 | Miller . | |
| 3,414,927 | 12/1968 | Worcester | 15/104.93 |
| 3,686,125 | 8/1972 | Miller . | |
| 3,780,908 | 12/1973 | Fitzpatrick et al. | 221/48 |
| 3,993,190 | 11/1976 | Schmidgall . | |
| 4,322,003 | 3/1982 | Long | 206/525 |
| 4,745,021 | 5/1988 | Ping, II . | |
| 4,817,790 | 4/1989 | Porat et al. | 206/205 |
| 4,847,089 | 7/1989 | Kramer et al. | 424/405 |
| 4,901,851 | 2/1990 | Gerry | 206/223 |
| 4,946,033 | 8/1990 | Conner | 206/223 |
| 5,111,934 | 5/1992 | Morin | 206/229 |
| 5,238,587 | 8/1993 | Smith et al. . | |
| 5,380,110 | 1/1995 | Festa | 401/132 |
| 5,547,476 | 8/1996 | Siklosi et al. . | |
| 5,568,866 | 10/1996 | Grosskopf et al. . | |
| 5,590,785 | 1/1997 | Seitzinger . | |
| 5,639,532 | 6/1997 | Wells | 428/95 |
| 5,765,407 | 6/1998 | Choo et al. | 68/214 |

FOREIGN PATENT DOCUMENTS

| | | |
|---|---|---|
| 2467239 | 5/1981 | France . |
| 1129160 | 10/1968 | United Kingdom . |
| 9738618 | 10/1997 | WIPO . |

*Primary Examiner*—Lorna M. Douyon
*Attorney, Agent, or Firm*—Shenier & O'Connor

[57] ABSTRACT

A portable stain removal kit containing single use packets of various spotting agents and a stain guide directing use of the various spotting agents to effectively and professionally remove any type of known or unknown stain. The spotting agents include wet side spotting agents and a dry side spotting agent. Rinse solutions are provided to remove the wet side spotting agents. Non-woven, embossed, synthetic webs are impregnated with the various solutions and sealed within vapor-impervious packets. The stain guide features one side with stains removable by a single spotting agent and a second side with combination stains removable by two or more recommended spotting agents.

17 Claims, 5 Drawing Sheets

One Spotting Agent

Category 1, apply acidic wet side spotting agent 10.
stain types a, b, c, d - - - -

Category 2, apply alkaline wet side spotting agent 20.
stain types k, l, m, n - - - -

Category 3, apply dry side spotting agent 30.
stain types r, s, t, u - - - -

*Fig. 3A*

Two Spotting Agents

Category 4, apply acidic 10, rinse 40, alkaline 20, rinse 50 and dry 60.
stain type i.

Category 5, apply alkaline 20, rinse 50, acidic 10, rinse 40 and dry 60.
stain type ii.

Category 6, apply dry agent 30, acidic 10, rinse 40, and dry 60.
stain type iii.

Category 7, apply dry agent 30, alkaline 20, rinse 50 and dry 60.
stain type iv.

⋮

Three Spotting Agents

Category 10, apply dry agent 30, acidic 10, rinse 40, alkaline 20, rinse 50 and dry 60.
stain type vii.

Category 11, apply dry agent 30, alkaline 20, rinse 50, acidic 10, rinse 40 and dry 60.
stain type viii.

Category 12, apply acidic 10, rinse 40, alkaline 20, rinse 50, dry 60 and dry agent 30.
stain type ix.

⋮

*Fig. 3B*

COMPLETE INSTRUCTION MANUAL

Enclosed you will find 6 individual packets consisting of:

| | |
|---|---|
| Special Formula 1 | - F1 |
| Special Formula 2 | - F2 |
| Special Formula 3 | - F3 |
| Rinse Formula 1 | - R1 |
| Rinse Formula 2 | - R2 |
| Dry Formula 1 | - D1 |

Special Formula 1

Specifically removes:

Beer
Berries
Brandy
Cider
Cola
Coffee
Gin
Grape Juice
Grapefruit Juice
Jelly
Mouthwash
Saliva
Tea
Tomato Juice
Watermelon
Wine (white)

Special Formula 2

Specifically removes:

Blood
Caviar
Cocoa
Deodorant
Glue (water-based)
Meat Juices
Milk, Cream
Mucus
Perspiration
Starch (food)
Urine
Watercolors

Special Formula 3

Specifically removes:

Adhesive Tape
Crayon
Glue (rubber cement)
Grease
Make-up
Nail Polish
Nail Polish Remover
Oil
Paint
Shoe Polish

*Fig. 4A*

COMBINATION METHODS

The following stains can be removed by using the special formulas in a specific combination. Use each formula in the proper order listed below for the stain you wish to remove:

- Avocado
  F1, R1, F2, R2, D1
- Banana
  F1, R1, F2, R2, D1
- Burgundy
  F1, R1, F2, R2, D1
- Candy
  F1, R1, F2, R2, D1
- Catsup
  F1, R1, F2, R2, D1
- Chocolate
  F3, F2, R2, F1, R1, D1
- Cooking oil
  F3, F1, R1, D1
- Eggs
  F1, R1, F2, R2, D1
- Food (generic)
  F1, R1, F2, R2, D1, F3
- Fruit
  F1, R1, F2, R2, D1
- Grass
  F3, F1, R1, D1
- Gravy
  F2, R2, D1, F3
- Hand lotion
  F3, F1, R1, F2, R2, D1
- Ice cream
  F2, R2, F1, R1, D1
- Ink (carbon)
  F3, F2, R2, D1
- Ink (red)
  F2, R2, F1, R1, D1
- Pencil
  F3, F2, R2, D1
- Leather
  F3, F2, R2, D1
- Lipstick
  F3, F2, R2, F1, R1, D1
- Mascara
  F3, F2, R2, D1
- Vegetable
  F1, R1, F2, R2, D1
- Mud
  F3, F2, R2, F1, R1, D1
- Ointment
  F3, F2, R2, F1, R1, D1
- Polish shoe
  F3, F2, R2, D1
- Rouge
  F3, F1, R1, F2, R2, D1
- Soot
  F3, F2, R2, D1
- Syrup
  F1, R1, F2, R2, D1
- Vomit
  F2, R2, F1, R1, D1
- Wine (red)
  F1, R1, F2, R2, D1
- Unknown
  F3, F1, R1, F2, R2, D1

Fig. 4B

COMPREHENSIVE STAIN REMOVAL KIT

BACKGROUND OF THE INVENTION

1. Field of the Invention

The invention relates to a comprehensive stain removal kit. More particularly, it relates to a portable kit containing single use packets of various spotting agents and a stain guide directing use of the various spotting agents to effectively remove any type of known or unknown stain.

2. The Prior Art

Effective stain removal, particularly from delicate fabrics or expensive garments, has heretofore been relegated to commercial dry cleaning establishments. Stain removal is a complex art in that many different spotting agents are available to choose from depending on the nature of the stain and the material involved. The process is further complicated by the fact that improper use of the spotting agent can result in the undesirable effect of further setting the stain rather than removing it. In addition, many spotting agents have strict packaging and handling requirements, and special application methods. Finally, the difficulties of properly disposing of sizable quantities of these chemicals have limited their use to the aforementioned commercial dry cleaning establishments.

Certain attempts have been made to provide simplified cleaning products for home use. U.S. Pat. No. 2,980,941 to Miller, U.S. Pat. No. 3,686,125 to Miller and U.S. Pat. No. 3,993,190 to Schmidgall disclose various methods for delivering a cleaning solution for stain removal. While certain benefits are derived from the simplicity of providing a single cleaning agent, such compound may not be safe for all fabrics and will not be able to remove all stain types, particularly combination stains.

U.S. Pat. No. 5,238,587 to Smith et al and U.S. Pat. No. 5,547,476 to Siklosi et al propose dry cleaning chemicals for use within a residential clothes dryer. In many instances this may be as inconvenient as patronizing a commercial dry cleaning establishment. In addition, only a limited number of materials specify that they should be dry cleaned only.

Accordingly, it would be desirable to provide a comprehensive stain removal kit which can be conveniently used at any time, on any fabric, to remove any type of known or unknown stain.

SUMMARY OF THE INVENTION

It is a primary object of the present invention to provide a stain removal kit which is completely portable so that all of the elements may be readily available for use.

It is a further object of the present invention to provide a collection of spotting agents within the kit which can be safely applied to all fabrics.

It is yet another object of the present invention to provide a kit which enables the user to remove any type of known or unknown stain and requires only elements contained in the kit.

These and other related objects are achieved according to the invention by providing a kit with several different spotting agents. Initially spotting agents were selected from the categories of wet side spotting agents and dry side spotting agents. To provide comprehensive stain removal of any type of known or unknown stain with the least number of spotting agents, it was discovered that a single dry side spotting agent and two different wet side spotting agents, namely an alkaline wet side spotting agent and an acidic wet side spotting agent, would be required. Appropriately selected webs are impregnated with the various spotting agents and sealed within clearly labeled packets. Rinse solutions are similarly packaged along with a dry web. Proper use of the various spotting agents is detailed in a stain guide having many different categories, each category including a stain type and an indication of which webs to apply and in what order. When using the kit, the stain guide is initially consulted to determine the stain type. The webs listed for that stain type are then applied, in proper order, to remove the stain.

BRIEF DESCRIPTION OF THE DRAWINGS

In the accompanying drawings to which reference is made in the instant specification which is to be read in conjunction therewith and in which like reference numerals are used to indicate the parts in the various views:

FIGS. 3A and 3B show the general form of a stain guide according to the invention.

FIGS. 4A and 4B show a specific preferred embodiment of the stain guide.

DETAILED DESCRIPTION OF THE PREFERRED EMBODIMENT

Figure 1:
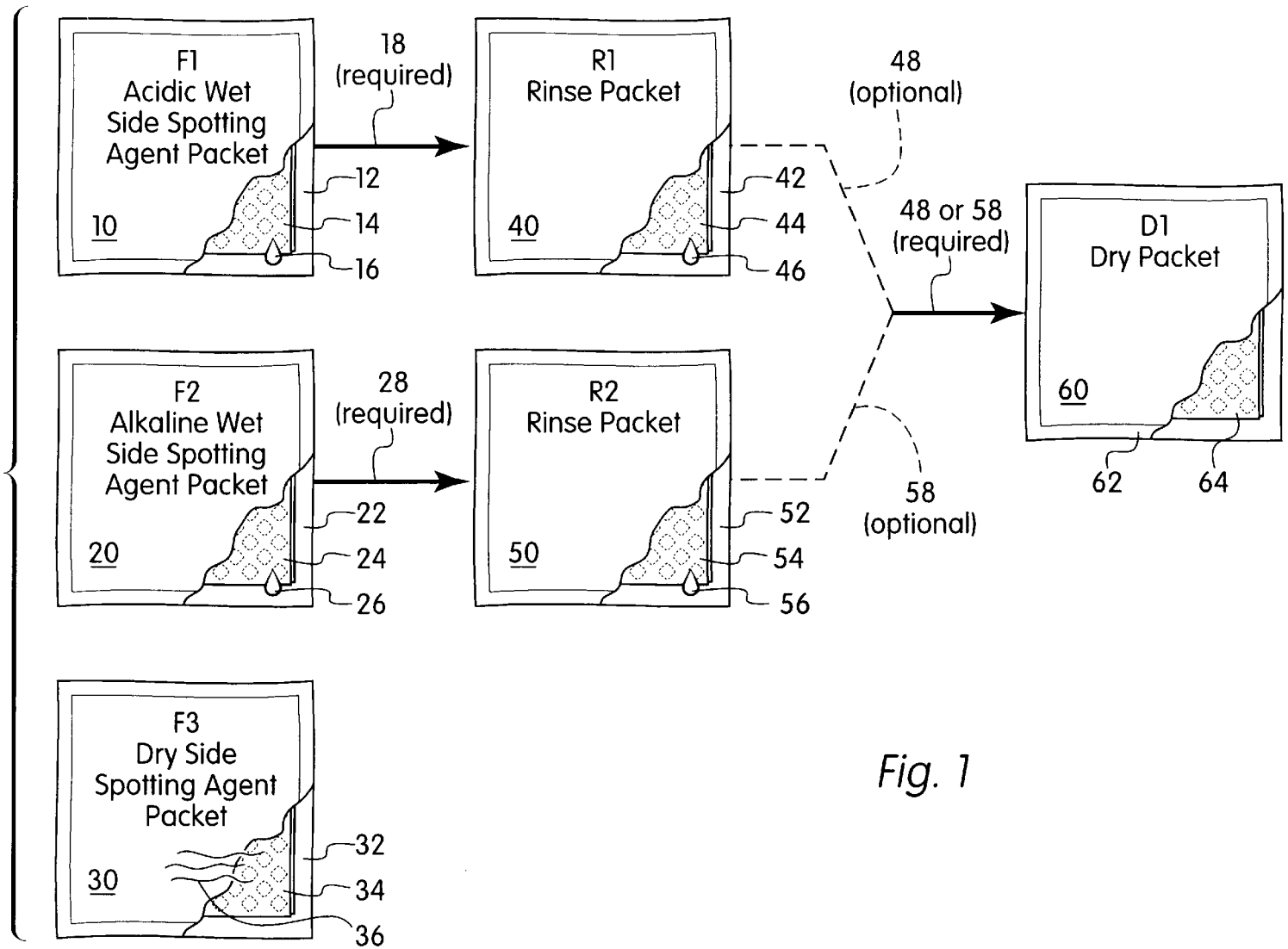
FIG. 1 is a fragmentary front side elevational view of the various packets contained within the stain removal kit according to the invention.

Referring now to FIG. 1, there is shown an acidic wet side spotting agent packet 10, an alkaline wet side spotting agent packet 20 and a dry side spotting agent packet 30. It was discovered that by using these three different spotting agents in various permutations that any type of known or unknown stain could be removed with professional results. Acidic wet side spotting agent 16 may include a tannin formula, acetic acid, oxalic acid or hydrofluoric acid. Alkaline wet side spotting agent 26 may include ammonia. Dry side spotting agent 36 may include volatile dry solvent, amyl acetate (banana oil) or oily type paint removers. These spotting agents are commercially available in proper dilutions and with appropriate additives suitable for direct contact with fabrics.

Spotting agents 16, 26 and 36 are impregnated into absorbent webs 14, 24 and 34, respectively. Since these spotting agents are typically applied in liquid form, it was important to select a web which would avoid chemical interaction with the spotting agents and simultaneously serve as a cleaning tool. The material selected is a non-woven, embossed applicator having a 3 to 1 rayon/polypropylene blend and is available under the trade name NOVONETTE sold by Veratec. The embossing on the applicator provides a textured surface which enhances mechanical cleaning action while providing recesses which hold dirt particles away from the fabric surface being cleaned. The same web material is used in all of the packets. Other synthetic blends or treated natural fibers could also be used.

The packets themselves are created from laminates 12, 22 and 32, which are cut into paired blanks and heat sealed along their peripheries. Any suitable vapor-impervious laminate may be used which avoids chemical interaction with the spotting agents. Laminates 12 and 22 contain an outer paper layer, an intermediate foil layer and an inner modified polyethylene ionomer layer which is heat-sealable. The same laminate is represented by reference numerals 42, 52 and 62. However, it was discovered that the dry side spotting agent 36 requires an additional layer of polyester between the inner heat seal layer and the foil layer, to protect the foil layer.

Rinse packet 40 and rinse packet 50 contain webs impregnated with distilled water. Dry packet 60 contains a dry web 64. Packet 10 and packet 40 are both labeled to indicate that web 44 should always be used immediately following web 14. Packet 20 and packet 50 are both labeled to indicate that web 54 should be used immediately after web 24. Packets 40, 50 and 60 are all labeled to indicate that after the final rinse with web 44 or 54, dry web 64 should be employed.

Figure 2:
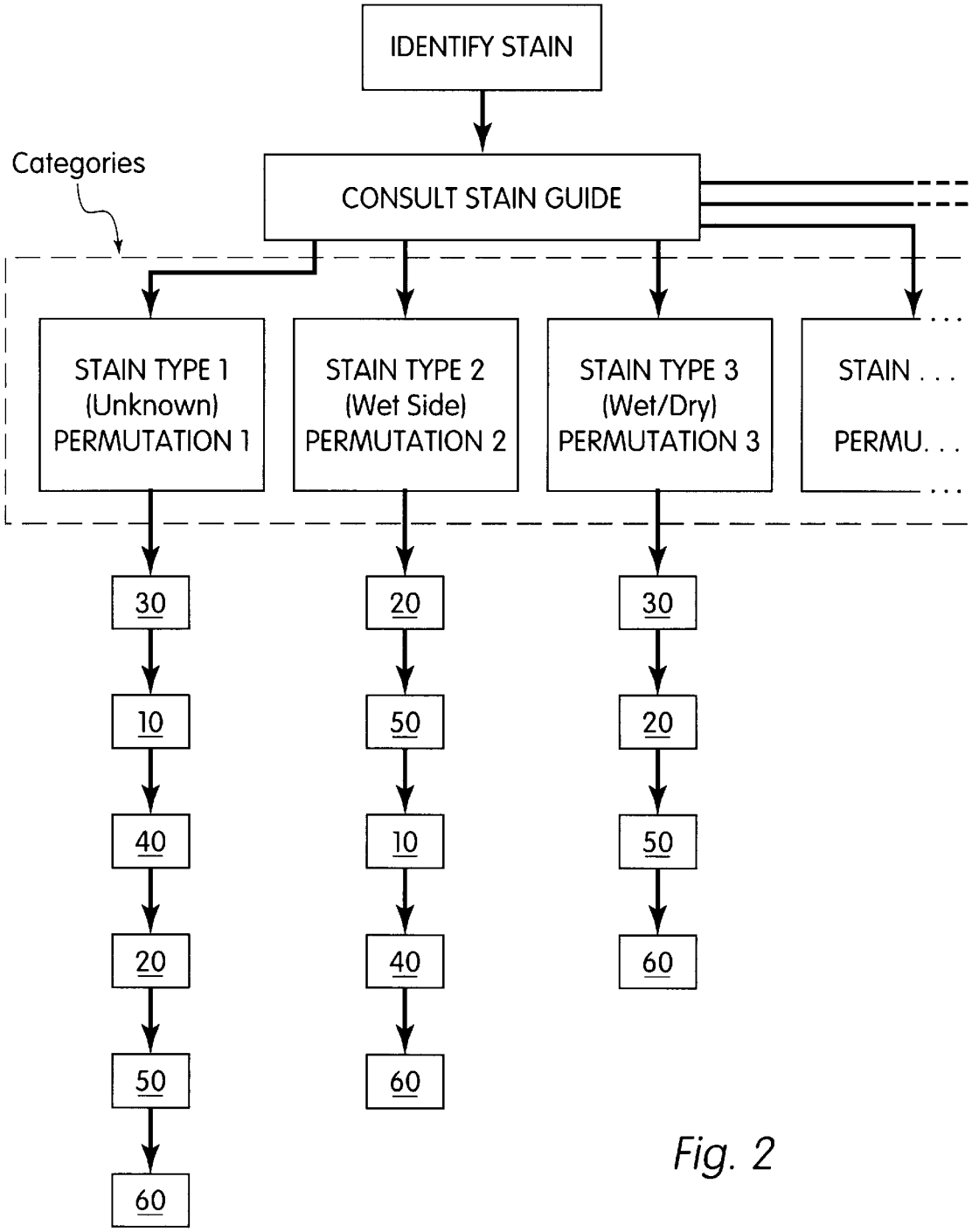
FIG. 2 is a flow chart indicating various steps for utilizing the kit.

Referring now to FIG. 2, use of the kit begins with attempting to identify the stain and consulting the stain guide. If the stain type is unknown, permutation 1 indicates use of packets 30, 10, 40, 20, 50 and 60, in that order. For certain wet side stains, permutation 2 indicates packets 20, 50, 10, 40 and 60. For a particular combination stain permutation 3 indicates packets 30, 20, 50 and 60. Many other stain types and permutations are provided as can be seen in FIGS. 3A, 3B, and 4A, 4B. FIG. 3A schematically illustrates a general form for side one of the stain guide containing the first three categories which only call for a single spotting agent. As indicated earlier, packets 10 and 20 direct the immediate subsequent use of packets 40 and 50 which then indicate the use of packet 60. Packet 30 may be used alone.

FIG. 3B schematically illustrates a general form for side 2 of the stain guide. These categories comprise combination stains which are removable by two or more recommended spotting agents only. The classifications of two spotting agents may contain up to six categories. However, only five are recommended with the F1, F3 combination being omitted. The classifications of three spotting agents may contain up to six different categories. However, only three are recommended with the F1, F3, F2 combination, the F2, F3, F1 combination and the F2, F1, F3 combination being omitted. For the combination stains, the stain guide contains detailed indications of all the packets that are required and in what order they should be applied.

The formulas listed in FIG. 4A (and FIG. 4B) correlate with the packets of FIG. 1 as detailed in the following Table 1.

TABLE 1

Formula-to Packet Correlation

| FIG. 4A Formula | Packet Reference Numeral in FIG. 1 |
|---|---|
| Special Formula 1 - F1 | 10 |
| Special Formula 2 - F2 | 20 |
| Special Formula 3 - F3 | 30 |
| Rinse Formula 1 - R1 | 40 |
| Rinse Formula 2 - R2 | 50 |
| Dry Formula 1 - D1 | 60 |

Packet labelling F1, F2, F3, R1, R2 and D1 renders use of the kit as easy as cleaning by numbers. For example, in FIG. 4B the permutation for avocado is indicated as F1 (10), R1 (40), F2 (20), R2 (50) and D1 (60). The unknown stain, as indicated earlier, indicates the permutation F3, F1, R1, F2, R2, D1. The user simply lines up the packets and sequentially opens a packet and rubs the stain with the web, until all specified packets have been used, to professionally remove any type of stain.

Through careful classification, a self-contained kit with three different spotting agents has been provided which meets the objects of the invention. The total six packets and stain guide are packaged together to be completely portable and carried in a car, jacket pocket, or purse, stored at home or in the office, or provided by a restaurant, hotel, store or other establishment. Comprehensive stain cleaning has been achieved, i.e. for any material and containing any known or unknown stains, with professional results.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A comprehensive stain removal kit comprising in combination:

(A) three spotting agents for cleaning known and unknown stains from any fabric consisting essentially of a first vapor-impervious packet containing a first absorbent web impregnated with an acidic wet side spotting agent (F1), a second vapor-impervious packet containing a second absorbent web impregnated with an alkaline wet side spotting agent (F2), and a third vapor-impervious packet containing a third absorbent web impregnated with a dry side spotting agent (F3);

(B) a rinse solution for rinsing said wet side spotting agents from the fabric; and (C) a stain guide including three categories, each category comprising a stain type and an indication of what order to apply said three spotting agents, wherein the indications for said three categories consist of:

| Category | Stain Type | Indication |
|---|---|---|
| 1 | Chocolate, Lipstick, Ointment, Mud | F3 followed by F2 followed by F1 |
| 2 | Food | F1 followed by F2 followed by F3 |
| 3 | Unknown Stain, Handlotion, Rouge | F3 followed by F2. |

.

2. The kit of claim 1, further comprising a dry absorbent web.

3. The kit of claim 2, wherein said first and second packets include indications to subsequently apply said rinse solution.

4. The kit of claim 2, wherein said category comprising an unknown stain comprises the following indications:

said third web impregnated with said dry side spotting agent, said first web impregnated with said acidic wet side spotting agent, said rinse solution, said second web impregnated with said alkaline wet side spotting agent, said rinse solution, and said dry absorbent web.

5. The kit of claim 1, wherein said acidic wet side spotting agent includes acetic acid.

6. The kit of claim 1, wherein said acidic wet side spotting agent includes oxalic acid.

7. The kit of claim 1, wherein said acidic wet side spotting agent includes hydrofluoric acid.

8. The kit of claim 1, wherein said alkaline wet side spotting agent comprises ammonia.

9. The kit of claim 1, wherein said dry side spotting agent is selected from the group consisting of a volatile dry solvent, amyl acetate and oily paint removers.

10. The kit of claim 1, wherein said vapor-impervious packets are made from a heat-sealable laminate having a layer which is inert with respect to said spotting agents.

11. The kit of claim 10, wherein said laminate includes an inner heat seal layer and a foil layer which is inert with respect to both of said wet side spotting agents.

12. The kit of claim 11, wherein said third vapor-impervious packet includes a protective layer, disposed between said foil layer and said inner heat seal layer, which is inert with respect to said dry side spotting agent.

13. The kit of claim 12, wherein said protective layer comprises polyester.

14. The kit of claim 1, wherein said webs are inert with respect to said spotting agents.

15. The kit of claim 14, wherein said webs are non-woven, embossed webs.

16. The kit of claim 14, wherein said webs are selected from the group consisting of treated, natural fibers and synthetic fibers.

17. The kit of claim 14, wherein said webs are made from rayon and polyester.

* * * * *

UNITED STATES PATENT AND TRADEMARK OFFICE

CERTIFICATE OF CORRECTION

PATENT NO. : 6,013,614
DATED : January 11, 2000
INVENTOR(S) : John Mahdessian

It is certified that error appears in the above-identified patent and that said Letters Patent is hereby corrected as shown below:

Column 4, claim 1,
Line 45, after the word "Rouge" should read -- F3 followed by F1 followed by F2. --

Signed and Sealed this

Fifteenth Day of January, 2002

*Attest:*

*Attesting Officer*

JAMES E. ROGAN
*Director of the United States Patent and Trademark Office*